United States Patent [19]

Toyoshi et al.

[11] Patent Number: 4,891,287

[45] Date of Patent: Jan. 2, 1990

[54] IMAGE EDITING METHOD

[75] Inventors: Naoki Toyoshi; Hiroshi Okamoto; Kenji Tabuchi; Kaoru Takebe; Tomoaki Yokoyama, all of Osaka, Japan

[73] Assignee: Minolta Camera Kabushiki Kaisha, Osaka, Japan

[21] Appl. No.: 201,195

[22] Filed: Jun. 2, 1988

[30] Foreign Application Priority Data

Jun. 3, 1987 [JP] Japan ..... 62-140494

[51] Int. Cl.[4] ..... G03G 15/046

[52] U.S. Cl. ..... 430/54; 355/218; 355/245; 355/268; 430/100; 430/126

[58] Field of Search ..... 355/7, 4, 32, 77, 133; 430/100, 45, 54, 42, 126

[56] References Cited

U.S. PATENT DOCUMENTS

| | | | |
|---|---|---|---|
| 3,808,026 | 4/1974 | Sato et al. | 430/42 X |
| 3,963,341 | 6/1976 | Tully | 355/4 |
| 4,579,443 | 4/1986 | Abuyama et al. | 355/4 |
| 4,582,417 | 4/1986 | Yagasaki et al. | 355/7 |
| 4,720,750 | 1/1988 | Watanabe | 355/4 X |

FOREIGN PATENT DOCUMENTS

| | | | |
|---|---|---|---|
| 950767 | 7/1974 | Canada . | |
| 0026706 | 12/1964 | Japan | 430/100 |
| 0122060 | 9/1981 | Japan | 355/7 |

*Primary Examiner*—A. T. Grimley
*Assistant Examiner*—Robert Beatty
*Attorney, Agent, or Firm*—Burns, Doane, Swecker & Mathis

[57] ABSTRACT

An image editing method utilizing an electrophotographic process, which method includes a first charging step of charging a photosensitive medium; a step of projecting an image onto the charged photosensitive medium to form an electrostatic latent image; a first developing step of developing the electrostatic latent image into a first powder image by the use of a first toner material having the same polarity as the charged polarity; a first transferring step of transferring the powder image onto a copying paper; a second charging step of again charging the photosensitive medium to a polarity the same as that of the charge established during the first charging step; a step of radiating rays of light to the charged photosensitive medium to remove the electrostatic charge at a specificed area of the photosensitive medium; a second developing step of developing the specified area of the photosensitive medium by the use of a second toner material different in color from the first toner material to form a second powder image; and a second transferring step of transferring the second powder image onto said copying paper so as to cover the first powder image which has been transferred onto the copying paper.

3 Claims, 3 Drawing Sheets

IMAGE EDITING METHOD

BACKGROUND OF THE INVENTION

1. Field of the Invention

The present invention generally relates to an electrophotographic process and, more particularly, to an image editing method utilizing a reversed image forming device to modify a portion of an image.

2. Description of the Prior Art

Copying machines available nowadays in the market employ a so-called standard developing system wherein an image of the original document to be copied is projected onto a uniformly electrostatically charged photosensitive surface of a photoreceptor drum thereby to deplete the electrostatic charge at a background area other than at the area which has been exposed to the image of the original document, i.e., to form an electrostatic latent image, which is subsequently developed into a powder image by the application of toner particles having an electrical polarity opposite to that of the electrostatic charge built up at that area.

Because of this, it is possible to arrange a plurality of light emitting diodes between the image exposing station and the developing station so as to extend in a direction parallel to the axis of the latent image carrier so that, by arbitrarily controlling the combination and the timing of some or all of the light emitting diodes to be lit, an image editing can be accomplished wherein the electrostatic charge is partially removed to remove the image.

However, in a system such as, for example, a laser printer, wherein a reversed developing system is employed, a laser beam is radiated onto the electrostatically charged photosensitive surface of the latent image carrier to remove the electrostatic charge at an image area so that electrically charged toner particles can be subsequently applied thereto. Because of this, in order to accomplish the image editing wherein a portion of the image is removed, an area which is to be removed must be electrically charged and this is in contrast to that in the standard developing system.

Since the photosensitive surface of the latent image carrier is generally adapted to be electrostatically charged by the discharge taking place in a corona wire of an electrostatic charger which extends parallel to the photosensitive surface, it is not easy to achieve a partial charging of the photosensitive surface and, if not impossible, a substantial amount of equipment is required to achieve it, thereby posing a problem associated with economy.

SUMMARY OF THE INVENTION

Accordingly, the present invention has been devised with a view to substantially eliminate the above discussed problems and has for its essential object to provide an image editing method wherein a reversed image forming device employing the reversed developing system is used to revise a portion of the image.

The above discussed object of the present invention can be accomplished by the provision of the image editing method utilizing an electrophotographic process, which method comprises a first charging step of charging a photosensitive medium; a step of projecting an image onto the charged photosensitive medium to form an electrostatic latent image; a first developing step of developing the electrostatic latent image into a first powder image by the use of a first toner material having the same polarity as the charged polarity; a first transferring step of transferring the powder image onto a copying paper; a second charging step of again charging the photosensitive medium to a polarity the same as that of the charge established during the first charging step; a step of radiating rays of light to the charged photosensitive medium to remove the electrostatic charge at a specified area of the photosensitive medium; a second developing step of developing the specified area of the photosensitive medium by the use of a second toner material different in color from the first toner material to form a second powder image; and a second transferring step of transferring the second powder image onto said copying paper so as to cover the first powder image which has been transferred onto the copying paper.

BRIEF DESCRIPTION OF THE DRAWINGS

This and other objects and features of the present invention will become readily understood from the following description taken in conjunction with a preferred embodiment thereof with reference to the accompanying drawings, in which:

FIG. 5(*b*) is a diagram showing the arrangement of light emitting diodes;

DETAILED DESCRIPTION OF THE EMBODIMENT

Figure 1:
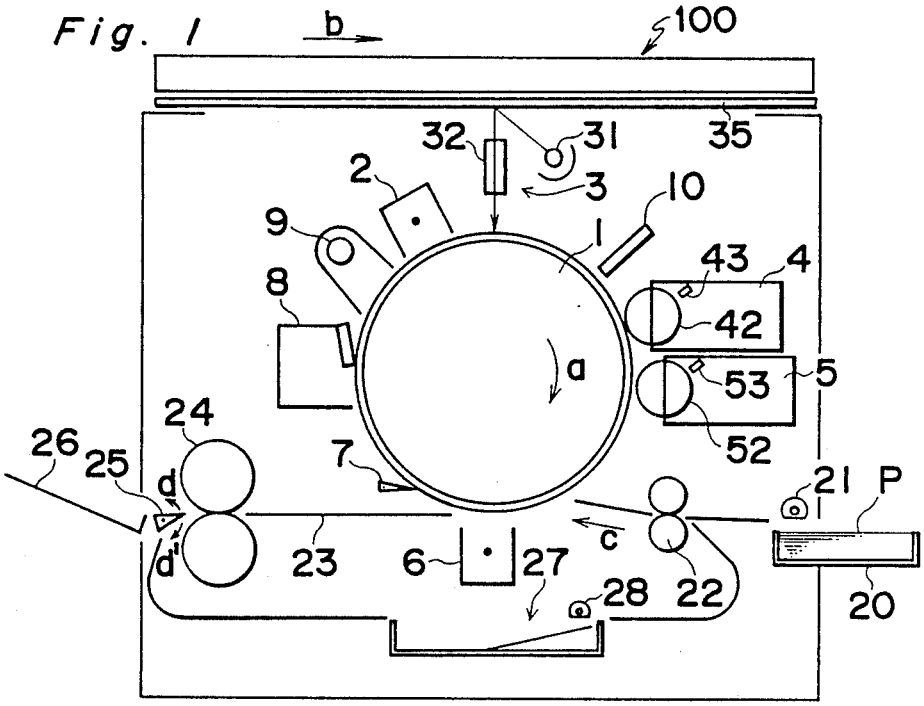
FIG. 1 is a schematic diagram showing an electrophotographic copying machine used to execute an image editing method of the present invention.

With particular reference to FIG. 1, an electrophotographic copying machine used to practice an image editing method of the present invention employs a reversed developing system and comprises a machine housing of generally rectangular box-like configuration, within which a photosensitive drum 1 is supported for rotation in one direction, for example, clockwise as shown by the arrow a, about a support shaft that defines the axis of rotation of such drum 1. As is well known to those silled in the art, during one complete rotation of the photosensitive drum 1, the photosensitive drum 1 moves sequentially past a charging station at which an electrostatic charger 2 is disposed for imparting an electrostatic charge (for example, a positive charge) of predetermined potential to the outer peripheral surface of the drum 1 forming a photosensitive surface; an exposure station at which a ribbon of light carrying an image of that original document placed on a movable document support 35 which is successively scanned by an image exposing device 3 during the movement of the document support 35 together with an image editing unit 100 is projected onto the photosensitive surface of the drum 1 to form an electrostatic latent image on the photosensitive surface of the drum 1 in a pattern complemental to the image of the original document; a developing station at which a developer material is applied to develop the electrostatic latent image into a visible powder image; a transfer station at which a transfer charger 6 is disposed for applying an electric field to a copying paper P, being supplied in a direction shown by the arrow c from a paper supply tray 20 by way of a feed roller 21 and also by way of a timing roller pair 22 synchronized with the rotation of the drum 1, so that the powder image can be electrostatically transferred onto a copying paper; and a cleaning station at which a blade-type cleaning unit 8 and an eraser lamp 9 are disposed one after another with respect to the direction of rotation of the drum 1 for removing residue toner and residue electrostatic charge remaining on the photosensitive surface of the drum 1, respectively, in readiness for the next cycle of electrophotographic copying process.

The copying paper having the powder image which has been transferred from the drum 1 at the transfer station is peeled off from the photosensitive surface of the drum 1 by a separating claw 7 and is then conveyed by a delivery conveyor 23 towards a fixing roller pair 24. Then, the copying paper having the image fixed thereon is transported towards a copy receiving tray 26.

The image exposing device 3 referred to above movable in a direction shown by the arrow b for scanning successive incremental portions of the original document placed on the document support 35 is of a slit exposure type and comprises an illuminator lamp 31 capable of emitting a ribbon of light used to illuminate that successive incremental portions of the original document as the document support 35 is moved, and a lens array 32 comprised of a plurality of light transmitting filaments in bundled configuration having a generally rectangular cross-section with its lengthwise axis lying parallel to the axis of rotation of the drum 1. The lens array 32 is operable to guide and project rays of light which have been reflected from the original document and therefore carrying the image of the original document, onto the photosensitive surface of the drum 1.

The developing station includes a first developing unit 4 and a second developing unit 5, the first developing unit 4 positioned on the upstream side of the second developing unit 5 with respect to the direction a of rotation of the drum 1. So far illustrated, the first and second developing units 4 and 5 are of a well-known magnetic brush developing type, and the first developing unit 4 accommodates therein a first developer mix containing a white toner while the second developing unit 5 accommodates therein a second developer mix containing a black toner. For the purpose of the present invention, the first and second developing units 4 and 5 are selectively brought into operation during first and second image forming processes as will be described later.

For selectively driving the developing units 4 and 5, several methods can be employed. One method is that the first and second developing units, supported for movement in a direction towards and away from the photosensitive surface of the drum 1, are selectively driven towards and away from the photosensitive surface of the drum 1. Another method is that, while magnet rollers disposed inside a developing sleeve are provided for rotation through a predetermined angle, a switching is effected between a developing position, in which the magnetic pole confronts the photosensitive surface of the drum 1, and a non-developing position in which a spacing between magnetic poles confronts the photosensitive surface of the drum 1. A still another method is that the bias voltage applied to the developing sleeve applied during the non-developing position is decreased to a value lower than that applied during the developing position.. In any event, all of these methods are disclosed in U.S. Pat. No. 4,752,802 which is herein incorporated by reference and, therefore, the details thereof will not be reiterated here.

In any event, the developer mix utilizable in any one of the first and second developing units 4 and 5 is a mixture of a mass of insulating toner particles with a mass of magnetic carrier beads, said toner particles and said carrier beads being capable of triboelectrically charging to respective polarities opposite to each other. Specifically, in the illustrated instance, the toner particles can be triboelectrically charged to a polarity (positive) same as the polarity of the electrostatic charge developed by the electrostatic charger 2. The specific manner by which the developer mix in any one of the first and second developing units 4 and 5 is transported so as to develop the electrostatic latent image on the photosensitive surface of the drum 1 into the visible powder image is well known in the art and, therefore, the details thereof will not be herein reiterated for the sake of brevity.

Figure 5A:
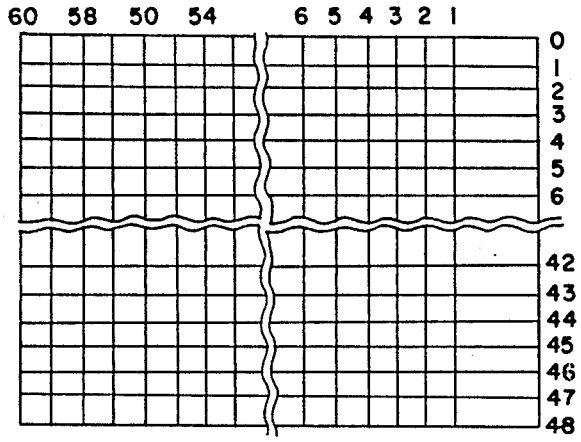
FIG. 5(*a*) is a top plan view of an image editing unit.
Figure 5B:
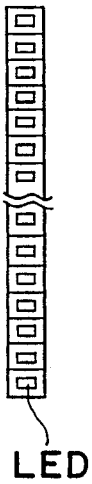

Positioned radially outwardly of the photosensitive drum 1 and between the exposure station and the developing station is an inter-image eraser 10 used to remove electric charges by the application of light onto the photosensitive surface of the drum 1. This inter-image eraser 10 comprises a plurality of light emitting diodes housed in a multistage fashion within a holder arranged so as to extend in a direction parallel to the axis of rotation of the photosensitive drum 1. This inter-image eraser 10 can function as an editing unit when a combination of the light emitting diodes to be lit and the timing at which they are to be lit are suitably controlled, and, as shown in FIG. 5(*a*), the inter-image eraser 10 can emit light towards each of blocks divided in a direction conforming to the direction of rotation of the photosensitive drum 1 and also in a direction perpendicular thereto.

Mounted on the movable document support 35 so as to cover the document support 35 is the image editing unit 100, the structure and the function of which will be described later. However, it is to be noted that this image editing unit 100 is movable together with the document support 35.

Positioned generally beneath the photosensitive drum 1 is a paper recirculating unit 27 for recirculating the copying paper from the transfer station back to the transfer station via the fixing station for the purpose which will become clear from the subsequent description.

At the outset, an area R of the document OD in which the image is desired to be revised is specified.

In the illustrated embodiment, the area R can be specified by the utilization of the image editing device 100

Figure 6:
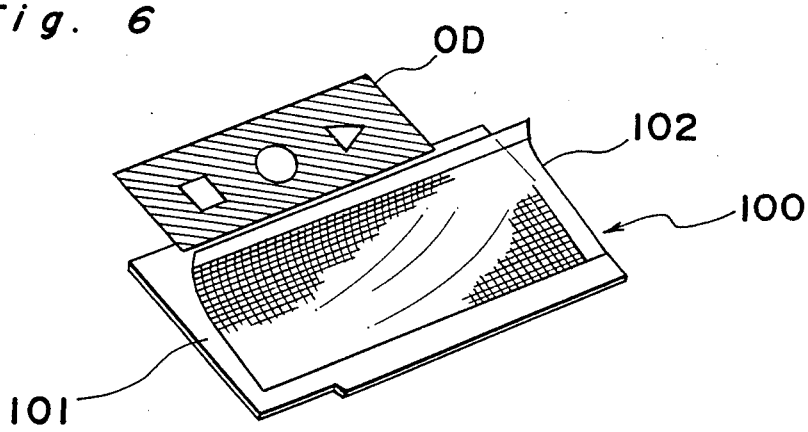
FIG. 6. is a perspective view of the image editing unit.
Figure 7:
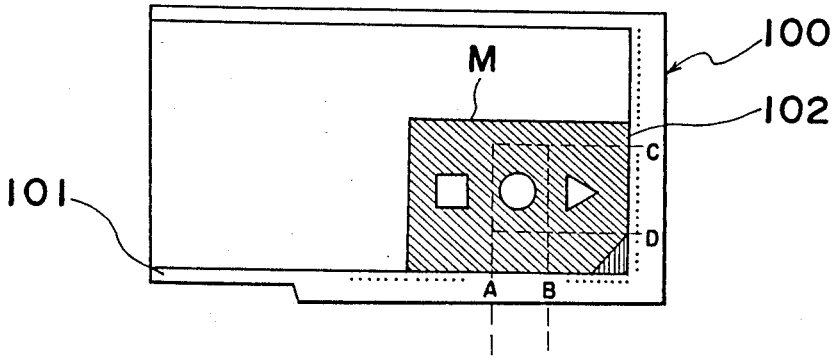
FIG. 7 is a top plan view of the image editing unit showing the manner in which an area is being specified.
Figure 8:
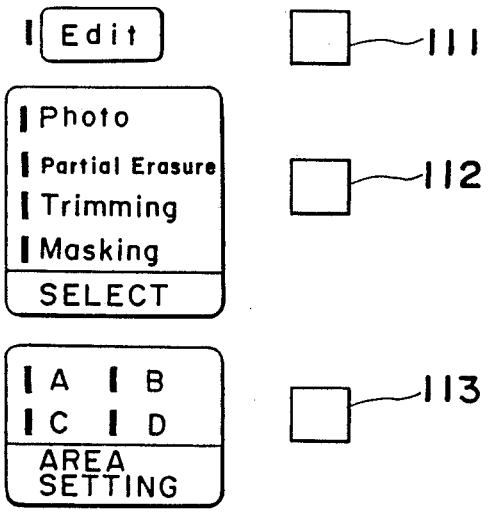
FIG. 8 is a diagram showing various operating buttons provided in the image editing unit.
Figure 9:
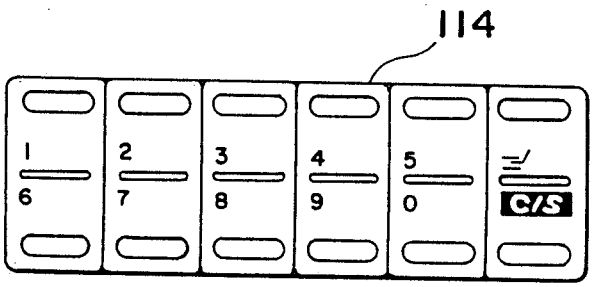
FIG. 9 is a diagram showing tens keys arranged in an operating panel in the copying machine.

(FIGS. 6 and 7), mounted atop the copying machine, and some of a number of keys (FIGS. 8 and 9) disposed on an operating panel. As best shown in FIGS. 6 and 7, the image editing device 100 is comprised of a generally rectangular document holder 101, which serves as a document retaining means operable to press the document OD against the document support 35 and which is, therefore, supported for pivotal movement between opened and closed positions, and an image editing map 102. The document holder 101 has scale calibrations formed at at least one of the opposite side edges thereof and also at at least one of the opposite ends thereof. The image editing map 102 is in the form of a generally rectangular transparent sheet having an imprinted, or otherwise embossed, grid pattern of a plurality of blocks, as best shown in FIG. 5(*a*), and secured at one side to the corresponding side edge of the document holder 101 for selective opening and closing.

The document OD is sandwiched between the document holder 101 and the transparent image editing map 102 with the image on the document OD oriented upwards, and, then, coordinates A, B, C and D corresponding to four corners of that area R of the document OD desired to be revised are to be read.

Subsequently, an editing mode selector switch 111 disposed on the operating panel has to be turned on to set the machine in the image editing mode, followed by depression of a selector switch 112 to select a partial erasure mode. Then, a AREA SETTING button 113 is depressed to key in the coordinates A to D by manipulating some of the tens keys 114. Data so inputted, that is, keyed in, can be stored in a control unit (not shown).

After a preparatory procedures has been finished in the manner as hereinabove described, the document OD is placed on the document support, and a PRINT switch is to be subsequently depressed to initiate the actual copying operation which will now be described.

When the copying operation is initiated subsequent to the specification of area R of the document OD in which the image is desired to be formed, a first image forming process is executed. It is to be noted that, during the execution of this first image forming process, only the second developing unit 5 is utilized and is brought into operation while the first developing unit 4 is held inoperative or retracted away from the photosensitive drum 1.

While the photosensitive drum 1 is rotated in the direction shown by the arrow a, the photosensitive surface of the drum 1 is uniformly charged by the electrostatic charger 2 to the positive polarity. Then, as the illuminator lamp 31 of the image exposing unit 3 illuminates the document OD on the document support 35 while the latter is moved to scan successive incremental portions of the document OD, rays of light reflected from, and carrying the image of, the document OD are projected on the photosensitive surface of the drum 1 through the lens array 32 to form an electrostatic latent image. When the imagewise light is so cast upon the photosensitive surface of the drum, the charges in that portion of the photosensitive surface of the drum 1 which has been exposed to the imagewise light are depleted to form an electrostatic latent image while the electrostatic charge on the background portion thereof is retained.

During the continued rotation of the drum 1, the electrostatic latent image is moved past the first developing unit 4, then held inoperative, towards the second developing unit 5. As this electrostatic latent image moves past the second developing unit 5, black toner particles which are charged to a positive polarity same as the polarity of the electrostatic charge are applied over the electrostatic latent image to form a black powder image Tb which corresponds to the image portion where there is no electrostatic charges. It is to be noted that, at this time, since the first developing unit 4 is held inoperative, no white toner particles are applied over the image area of the electrostatic latent image.

Simultaneously with the subsequent arrival of the powder image on the drum 1 at the transfer station, a copying paper P which is white in color in the illustrated instance is supplied by a paper supply roller 21 in a known manner from the paper supply tray 20 towards the transfer station for receiving the black powder image from the drum 1. Synchronization of the arrival of the copying paper P at the transfer station with the arrival of the black powder image on the drum at the transfer station can be accomplished by controlling the timing roller pair 22 in a manner well known to those skilled in the art. Transfer of the black powder image Tb from the drum 1 onto the copying paper P is effected by causing the transfer charger 6 to apply a charge on the copying paper P while the drum 1 and the copying paper P continue their respective movement.

The copying paper P having the black powder image Tb having been transferred thereto from the drum 1 at the transfer station is subsequently supplied by the conveyor 23 towards the fixing roller pair 24. As this copying paper P passes through the fixing roller pair 24, the black powder image Tb is firmly fixed on the copying paper in a manner known to those skilled in the art. The copying paper P having the black powder image fixed thereon is, as it emerges from the fixing roller pair 24, deflected by a changeover lever 25, then held at one (position d) of two positions d and d', so as to enter the paper recirculating unit 27 and is then retained temporarily, thereby completing the first image forming process.

During the further continued rotation of the drum 1, residue toner particles and residue electrostatic charge remaining on the photosensitive surface thereof are successively removed by the cleaning unit 8 and the eraser lamp 9, respectively.

Thereafter, the second image forming process takes place. During the execution of the second image forming process, the first developing unit 4 is brought into operation while the second developing unit 5 utilized during the execution of the first image forming process is held inoperative or retracted away from the photosensitive surface of the drum 1.

Figure 10:
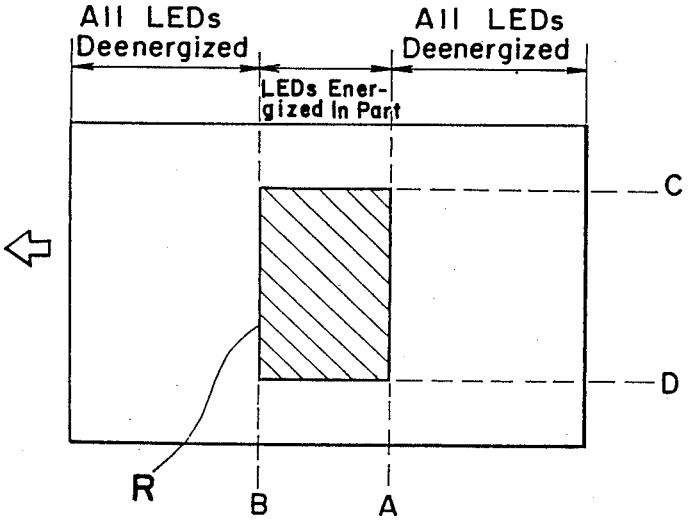
FIG. 10 is a diagram showing how the light emitting diodes are selectively lit in reference to the specified area.

While the drum 1 still continues to rotate in the direction shown by the arrow a, the photosensitive surface thereof is again uniformly charged by the electrostatic charger 2, followed by the projection of rays of light from some of the light emitting diodes of the interimage eraser 10 which correspond to the area specified by an area specifying means in a manner as shown in FIG. 10, so that the electrostatic charge set up on the area R of the photosensitive surface of the drum 1 can be depleted. The electrostatic latent image is subsequently brought to the developing station at which white white toner particles are applied by the first developing unit 4 onto the specified area R of the photosensitive surface of the drum 1 to form a white powder image Tw.

On the other hand, the copying paper P retained in the paper recirculating unit 27 after having been transferred with the powder image Tb during the execution of the first image forming process is supplied by a paper supply roller 28 towards the timing roller pair 22 in synchronism with the rotation of the drum 1 and is then supplied through the timing roller pair 22 towards the transfer station in synchronism with the arrival of the white powder image Tw at the transfer station. Thus, by the effect of the discharge of the transfer charger 6, the white powder image Tw can be transferred onto the area R of the copying paper P so as to "overprint" the black toner particles Tb.

The copying paper having the white powder image Tw transferred thereto is conveyed by the conveyor 23 and is passed through the fixing roller pair 24 operable to fix the white powder image on the copying paper P in overlapping relation with the black powder image. Thereafter, the copying paper is ejected onto the copy receiving tray 28 having been guided by the changeover lever 25 then held at the position d'.

Thus, the image on the area R' is shaded by the toner particles having the same color as that of the copying paper as if the image on the area R' were to have been erased.

Figure 2A:
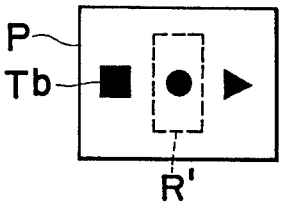
FIGS. 2(*a*) and 2(*b*) are top plan and side views of a copying paper bearing a reproduction of an image formed with a black toner material, respectively.
Figure 3:
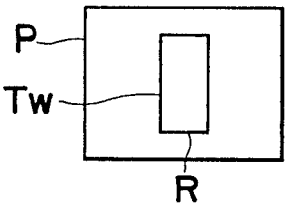
FIG. 3. is a top plan view of an electrostatic latent image carrier in developed form.
Figure 4A:
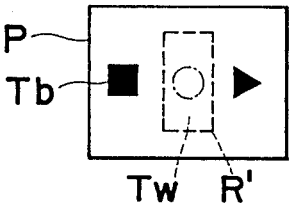
FIGS. 4(*a*) and 4(*b*) are top plan and side views of the copying paper bearing the image which has been edited, respectively.
Figure 2B:
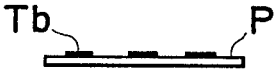
Figure 4B:
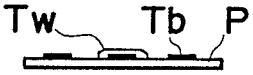

In the practice of the present invention, the first image forming process may not be executed. By way of example, if the copying paper P having an image copied thereon such as illustrated in FIG. 2(*a*) is placed on the paper supply tray 20 and is then supplied towards the transfer station, only the second image forming process is sufficient to edit the image on the copying paper P in a manner as shown in FIG. 4(*a*).

It is eventually indicated that it may happen that, when the white toner particles are transferred onto the copying paper in a quantity equal to the amount of the black and colored toner particles used to form the image, the image which has been formed on the copying sheet may be noticeable. This is particularly considerable where the image having a relatively large solid area is copied.

Accordingly, in practice of the image editing method according to the present invention, it is necessary to increase the amount of the white toner particles applied by the first developing unit 4 per unit surface area of the copying paper to a value greater than that of the black and colored toner particles, and for this purpose, at least one of the following means is to be employed.

1st Means: A developing gap between a developing sleeve 42, housed within the first developing unit 4 so as to confront the drum 1, and the photosensitive surface of the drum 1 must be smaller than a developing gap between a developing sleeve 52, housed within the second developing unit 5, and the photosensitive surface of the drum 1.

2nd Means: A bristle height adjusting gap defined between a bristle height adjusting member 43 for regulating the amount of developing material on the developing sleeve 42 and the developing sleeve 42 must be larger than a bristle height adjusting gap between a bristle height adjusting member 53 in the second developing unit 5 and the developing sleeve 52.

3rd Means: The speed of rotation of the developing sleeve 42 must be greater than that of the developing sleeve 52 within the second developing unit 5 to increase the amount of the developing material to be conveyed to a developing region between the developing sleeve 42 and the drum 1.

4th Means: A developing bias to be applied to the developing sleeve 42 must be greater than that to be applied to the developing sleeve 52 within the second developing unit 5.

5th Means: During the execution of the second image forming process, that is, during the developing with the use of the white toner particles, the potential remaining at the exposed area by the action of the inter-image eraser 10 must be lower than that during the execution of the first image forming process.

As hereinbefore described, the image editing method according to the present invention is effective in that, with the use of the image forming device employing the reversed developing system, the image at an area specified conveniently at the will of an operator of the copying machine can be revised (erased) to provide a revised image.

Also, by adjusting the composition of the white toner particles, the image formed with the white toner particles can be removed, to permit the copying machine to be used for leisure purposes.

Although the present invention has been described in connection with the preferred embodiment thereof with reference to the accompanying drawings, it is to be noted that various changes and modifications are apparent to those skilled in the art. Accordingly, such changes and modifications are to be understood as included within the scope of the present invention as defined by the appended claims unless they depart therefrom.

I claim:

1. An image editing method utilizing an electrophotographic process, which method comprises:

a first charging step of charging a photosensitive medium;

a step of projecting an image onto the charged photosensitive medium to form an electrostatic latent image;

a first developing step of developing the electrostatic latent image into a first powder image by the use of a first toner material having the same polarity as the charged polarity;

a first transferring step of transferring the first powder image onto a copying paper;

a second charging step of again charging the photosensitive medium to a polarity the same as that of the charge established during the first charging step;

a step of radiating rays of light onto the charged photosensitive medium to remove the electrostatic charge at a specified area of the photosensitive medium corresponding to a portion of the first powder image;

a second developing step of developing the specified area of the photosensitive medium by the use of a second toner material of the same color as that of the copying paper and of a different color from the first toner material to form a second powder image; and a second transferring step of transferring the second powder image onto the copying paper so as to cover the portion of the powder image which had been transferred onto the copying paper.

2. The method as claimed in claim 1, wherein the second toner particles are of white color.

3. An image editing method of erasing a portion of an image formed on a paper, with the use of an electrophotographic image forming device, which method comprises the steps of:

charging a photosensitive medium;

radiating rays of light onto the charged photosensitive medium to deplete an electrostatic charge set up at a predetermined area corresponding to a portion of the image formed on the paper;

developing the predetermined area on the photosensitive medium with the use of toner particles having the same color as that of the paper and also having the same polarity as that of the electrostatic charge, thereby to form a powder image; and transferring the powder image onto the image on the paper so as to cover said portion of the image on the paper.

* * * * *